US008017881B2

(12) United States Patent
Simmons

(10) Patent No.: US 8,017,881 B2
(45) Date of Patent: Sep. 13, 2011

(54) SIDE ENTRY CIRCUIT BREAKER

(75) Inventor: Roy Simmons, Roswell, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 364 days.

(21) Appl. No.: 12/370,711

(22) Filed: Feb. 13, 2009

(65) Prior Publication Data

US 2009/0242366 A1 Oct. 1, 2009

Related U.S. Application Data

(60) Provisional application No. 61/029,589, filed on Feb. 19, 2008, provisional application No. 61/084,719, filed on Jul. 30, 2008.

(51) Int. Cl.
*H01H 9/00* (2006.01)

(52) U.S. Cl. ..... 200/293; 200/51 R; 200/400; 335/202; 439/224; 439/717

(58) Field of Classification Search ..... 200/400, 200/401, 293, 295, 296, 297, 51 R, 51.11; 361/600, 627, 628, 631, 641, 643–647, 659, 361/660, 664–671; 439/224, 217, 709–717, 439/810–814; 335/202, 132
See application file for complete search history.

(56) References Cited

U.S. PATENT DOCUMENTS

| | | | | |
|---|---|---|---|---|
| 3,366,844 | A * | 1/1968 | Chamberlin, Jr. | 361/643 |
| 3,374,456 | A * | 3/1968 | Evans | 439/224 |
| 5,064,384 | A * | 11/1991 | Weaver | 439/511 |
| 6,589,071 | B1 * | 7/2003 | Lias et al. | 439/511 |
| 6,733,347 | B2 * | 5/2004 | Palet Mercader et al. | 439/810 |
| 6,923,680 | B2 * | 8/2005 | Dumont et al. | 439/582 |
| 7,084,727 | B2 * | 8/2006 | Bauer et al. | 335/132 |
| 7,559,807 | B2 * | 7/2009 | Freimuth et al. | 439/717 |
| 7,786,831 | B2 * | 8/2010 | Oh | 335/202 |

FOREIGN PATENT DOCUMENTS

| | | | |
|---|---|---|---|
| JP | 3074450 | U | 7/1991 |
| JP | 2002324472 | A * | 11/2002 |

* cited by examiner

*Primary Examiner* — Michael Friedhofer
(74) *Attorney, Agent, or Firm* — Jose R. de la Rosa

(57) ABSTRACT

A circuit breaker enables selective left, right or a combination of both side connection to a power conductor, such as a cable or wire. Side connection eliminates the need for large radius U-bends of the power conductor that is normally required when using top connection circuit breakers. An electrically non-conductive cavity commonly defined by left and right sides of the circuit breaker housing receives the power conductor in a connector such as a lug. The circuit breaker may have a visualization window oriented to observe whether excessive cable is projecting out of the lug, so as to confirm compliance with electrical code over surface spacing requirements. In some embodiments, the circuit breaker lugs are vertically oriented above its front cover surface in a receptacle portion of the housing. The receptacle may be constructed for selective lug orientation in horizontal or vertical positions by the installer.

20 Claims, 10 Drawing Sheets

SIDE ENTRY CIRCUIT BREAKER

CLAIM TO PRIORITY

This application claims the benefit of United States provisional patent application entitled "SIDE ENTRY CIRCUIT BREAKER" filed Feb. 19, 2008 and assigned Ser. No. 61/029,589, and also provisional patent application entitled "CIRCUIT BREAKER WITH DETACHABLE RECEPTACLE" filed Jul. 30, 2008 and assigned Ser. No. 61/084,719, both of which are incorporated by reference herein.

BACKGROUND OF THE DISCLOSURE

1. Field of the Invention

The present invention is directed to circuit breakers for circuit protection and control of electrical distribution systems. It is suitable for application in low voltage alternating current electrical systems commonly employed in residential and commercial structures.

2. Description of the Prior Art

Circuit breakers are often mounted in electrical enclosures, such as metering stacks. Referring to FIG. 1, the metering enclosure 10 is of an exemplary type commonly used in multiple unit occupancy buildings. The enclosure 10 has a plurality of stacked electric meters 12 that are coupled to an electric power grid so that they can provide rate-metered electric power to each corresponding occupancy unit. In FIG. 1, each meter is in turn wired to a downstream circuit breaker 14, often through a metering socket assembly having a pair of male stabs that plug into female biased jaws incorporated into the circuit breaker (not shown). The circuit breaker 14 has a pair of load terminals, often of a terminal lug configuration. Each lug is wired to one or more load wires or cables 16. Generally circuit breaker load terminals are configured at the top of the circuit breaker 12, as shown in FIG. 1.

FIG. 2 shows a prior art two-pole circuit breaker 20 that is sold by Siemens Energy & Automation, Inc. The circuit breaker 20 has a left load lug 22 that employs an allen screw 24 for crimped capture of a load cable. There is also a right lug 26 with corresponding allen screw 28. Both lugs 22, 24 are retained in a molded breaker housing 30 proximal the top side housing wall 32. The front cover 34 includes windows 36, 38 for access to the allen screws 24, 28.

Referring back to FIG. 1, the load cables 16 are routed from the top of the circuit breaker 12 in a U-shaped bend and down in a meter enclosure gutter. Alternatively, the cables 16 are routed in an upwardly direction in an "S-bend". The cables 16 thereafter exit the meter enclosure 10, for further distribution to the building occupancy units. Cable thickness dictates the U-bend or S-bend radius necessary for routing them from the circuit breaker to the gutter. As shown in FIG. 1, the cable 16 bend radius dictates minimum vertical spacing S between each meter 12 in the enclosure 10. It is desirable to minimize the vertical spacing S to maximize the number of meters that are stackable in an enclosure cabinet. Elimination of the need to form U-bends or S-bends in the load cables 16 is a desirable objective. One previous solution to eliminate the need for U-bend or S-bend formation in load cables was fabrication of a circuit breaker having side-access lugs.

FIG. 3 is a schematic representation of a left side-access circuit breaker 40 previously sold under the MURRAY® brand model designation 200V. The subject prior art circuit breaker 40 had a left lug 42 with allen screw 44 and a corresponding right lug 46 with allen screw 48. The circuit breaker housing 50 enabled left side access of load cables 16 along the left side wall 52. Front cover 54, along with upstanding internal walls 55 in the housing 50 captured and electrically isolated each respective breaker lug 42, 46. Windows 56, 58 enabled access to the allen screws 44, 46 for selective clamping of the load cables 16.

Full isolation of each of the lugs by surrounding insulating walls 55 and cover 54 was in compliance with electrical code over surface spacing requirements. For example, if a cable lug were not surrounded by insulating material on all sides with exception of the cable insertion direction, it might be possible to have excess cable protruding through the lug in violation of over surface spacing requirements. As a result of the over surface requirement, a drawback of the prior art breaker design 40 is that the lugs were configured at the factory for only left side load cable access, or in one other variation top access similar to the prior art circuit breaker of FIG. 2. If an electrical enclosure installation required right side cable routing rather than left side routing, the only practical recourse was to utilize a top-access circuit breaker.

It is desirable for electrical enclosure design an installation flexibility to eliminate the need for U-bend or S-bend cable clearances in applications that require left or right side cable gutter routing, or a combination of both in a single enclosure, while complying with electrical code over spacing requirements.

SUMMARY OF THE INVENTION

Accordingly, it is an object of the invention to configure a circuit breaker that eliminates the need to route cables with U-bends or S-bends and offers the flexibility of either left or right side cable routing, or both in any application, while complying with electrical code over spacing requirements.

Independent from the first object of the invention, it is an additional and separate object to provide additional cable routing flexibility to enable load cables to be inserted vertically into the circuit breaker lugs in a plane normal to and above the circuit breaker front cover in applications where it is desirable to route cables in a plane above the circuit breaker.

These and other objects are achieved by the circuit breaker of the present invention that enables selective side feed of load cables from either the left or right side or a combination of both. The circuit breaker of the present invention allows an enclosure designer to minimize wiring spacing within electrical enclosures by avoiding the need for complex cable bends, while complying with electrical code over surface spacing requirements.

One aspect of the present invention is directed to a circuit breaker having a housing defining a longitudinal axis, having left and right surfaces that are generally aligned with the longitudinal axis. The circuit breaker has an electrically non-conductive cavity commonly defined by the housing left and right surfaces, which is adapted for selective insertion and receipt of a power circuit conductor, such as a wire or cable, within either the left or right housing surface. The circuit breaker has a wiring connector that is retained within the cavity, adapted for retention of the power circuit conductor.

Another aspect of the present invention is directed to a circuit breaker having a housing defining a longitudinal axis, having left and right surfaces that are generally aligned with the longitudinal axis. An electrically non-conductive cavity is commonly defined by the housing left and right surfaces, that is adapted for selective insertion and receipt of a power circuit conductor, such as for example a wire or cable, within either the left or right housing surface. A wiring connector is retained within the cavity, adapted for retention of a power circuit conductor. The circuit breaker has an inspection window defined by the housing, such as in the cover. The window is oriented for visual inspection of at least a portion of the wiring connector and any power circuit conductor that is retained by the connector.

Yet another aspect of the present invention is directed to a circuit breaker having a housing defining a first longitudinal axis and a receptacle portion having left and right surfaces that are generally aligned with a second longitudinal axis, wherein the respective longitudinal axes are aligned generally normal to each other. An electrically non-conductive cavity is commonly defined by the receptacle left and right surfaces, that is adapted for selective insertion and receipt of a power circuit conductor within either the left or right surface. A wiring connector is retained within the cavity, adapted for retention of a power circuit conductor.

There is also another aspect of the present invention that is directed to a circuit breaker having a housing defining a first longitudinal axis and a receptacle having left and right surfaces that are generally aligned with a second longitudinal axis. The receptacle is selectively attachable to the housing in a first orientation with the respective longitudinal axes aligned generally in parallel and in a second orientation with the respective longitudinal axes aligned generally normal to each other. An electrically non-conductive cavity is commonly defined by the receptacle left and right surfaces, that is adapted for selective insertion and receipt of a power circuit conductor, such as a cable or wire, within either the left or right surface. The circuit breaker has a wiring connector that is retained within the cavity, adapted for retention of a power circuit conductor.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

After considering the following description, those skilled in the art will clearly realize that the teachings of my invention can be readily utilized in making and using the circuit breaker of the present invention.

Figure 1:
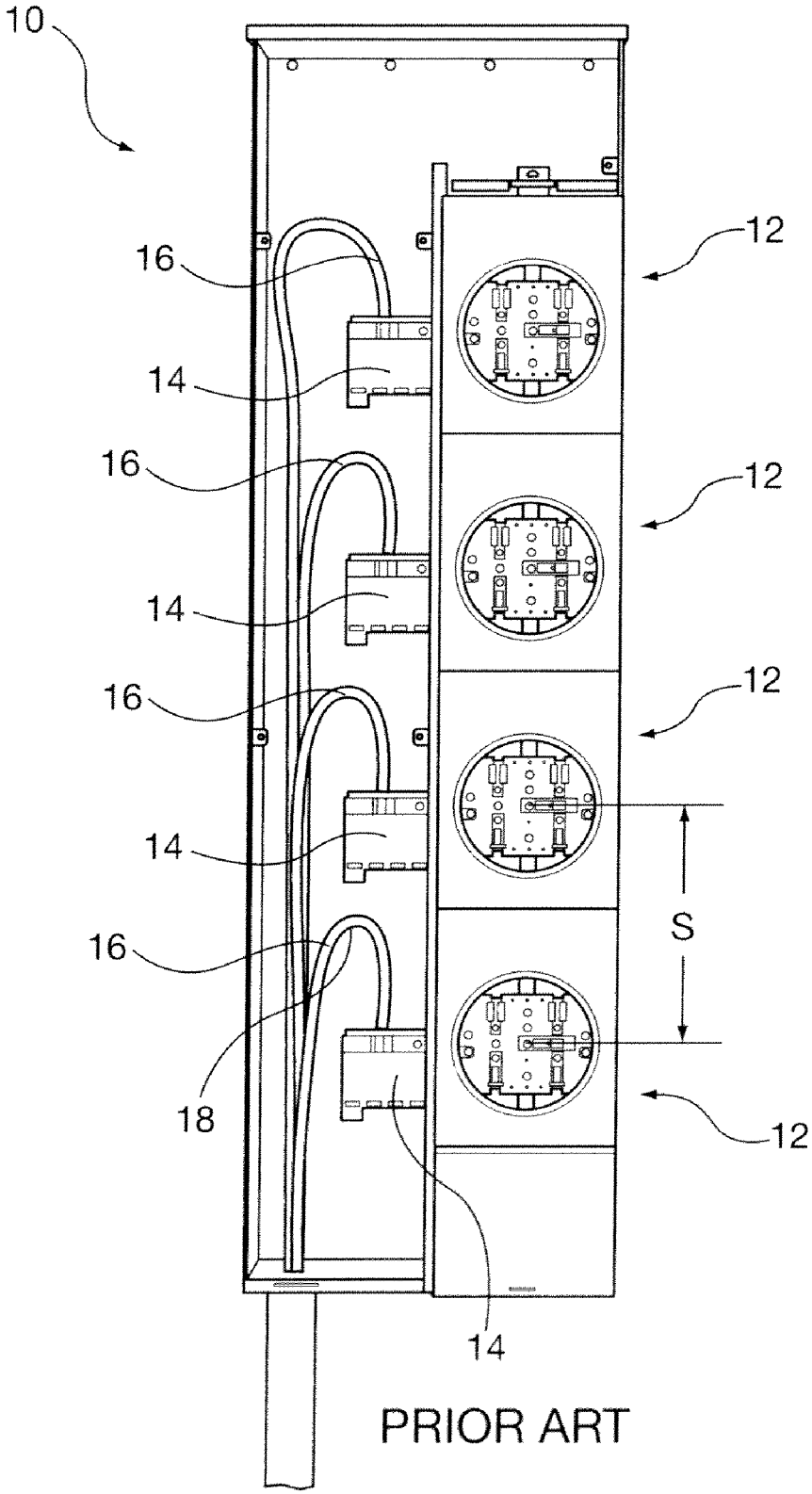
FIG. 1 is a schematic elevational drawing of a prior art metering stack electrical enclosure.
Figure 2:
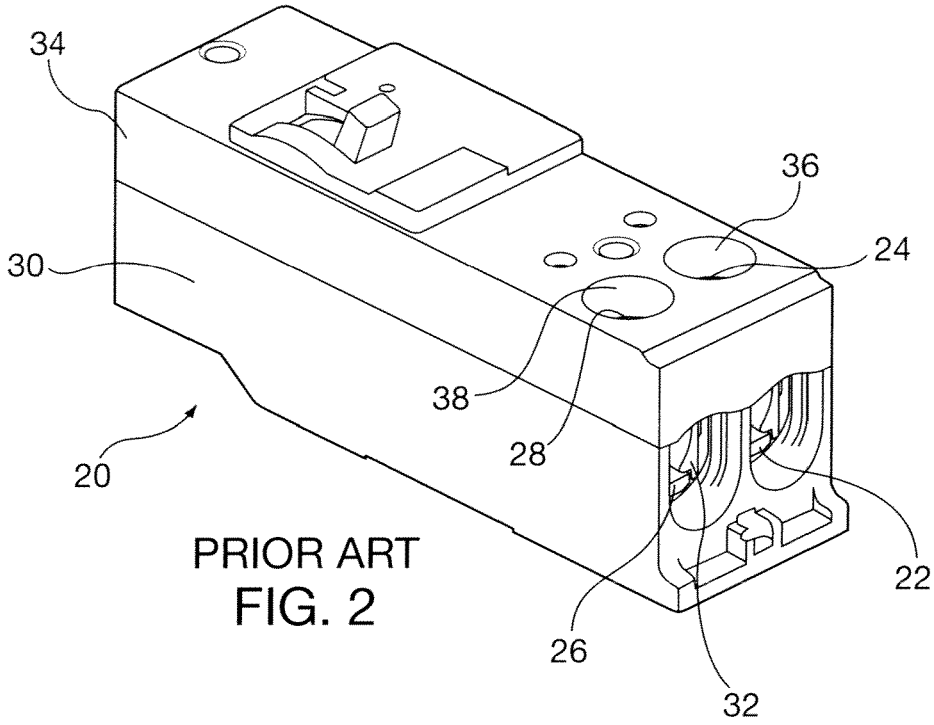
PRIOR ART FIG. 2
FIG. 2 is a perspective view of a prior art top feed-type circuit breaker.
Figure 3:
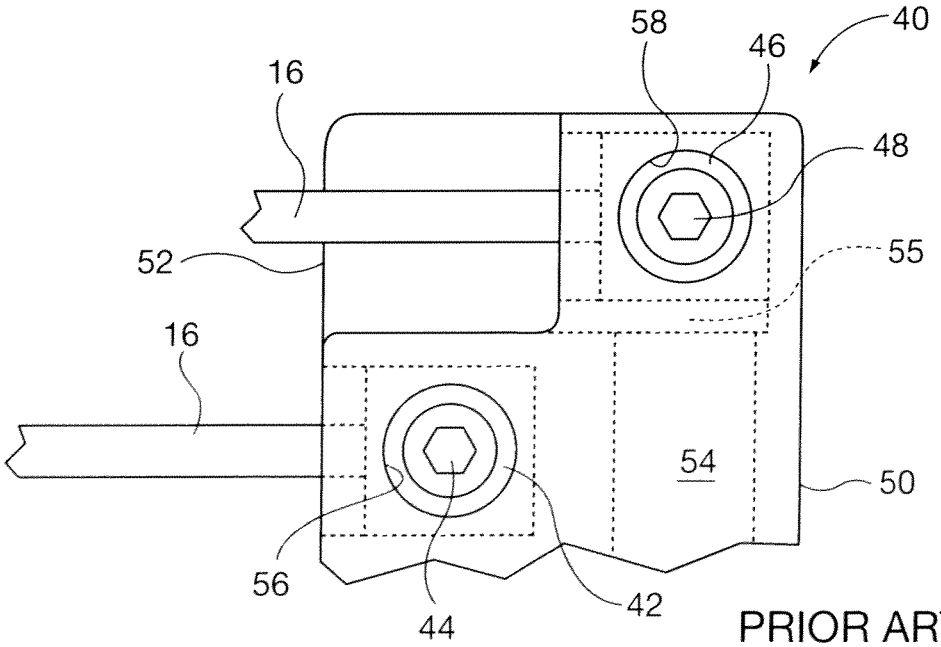
PRIOR ART FIG. 3
FIG. 3 is a schematic partial front elevational view of a prior art left side feed circuit breaker.

FIGS. 1-3, depicting prior art electrical enclosures and circuit breaker designs have been described in the Background of the Disclosure section, above. The prior art circuit breakers did not offer the design application flexibility to enable left or right side wiring connection or a combination of both. Lugs were permanently oriented to enable only left or top side wiring, among other reasons to comply with electrical code over surface spacing requirements, so that wire or cable conductors were maintained at a minimum distance from other components within the electrical enclosure.

Figure 4:
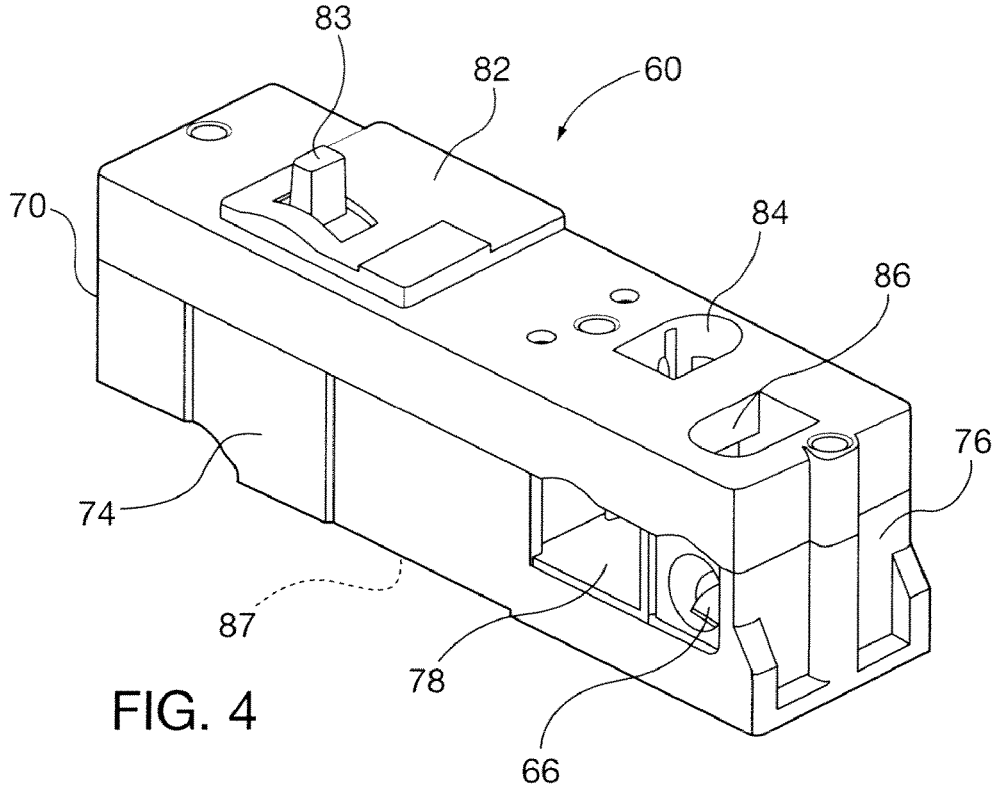
FIG. 4 is a top right side perspective view of an embodiment of a circuit breaker of the present invention.
Figure 5:
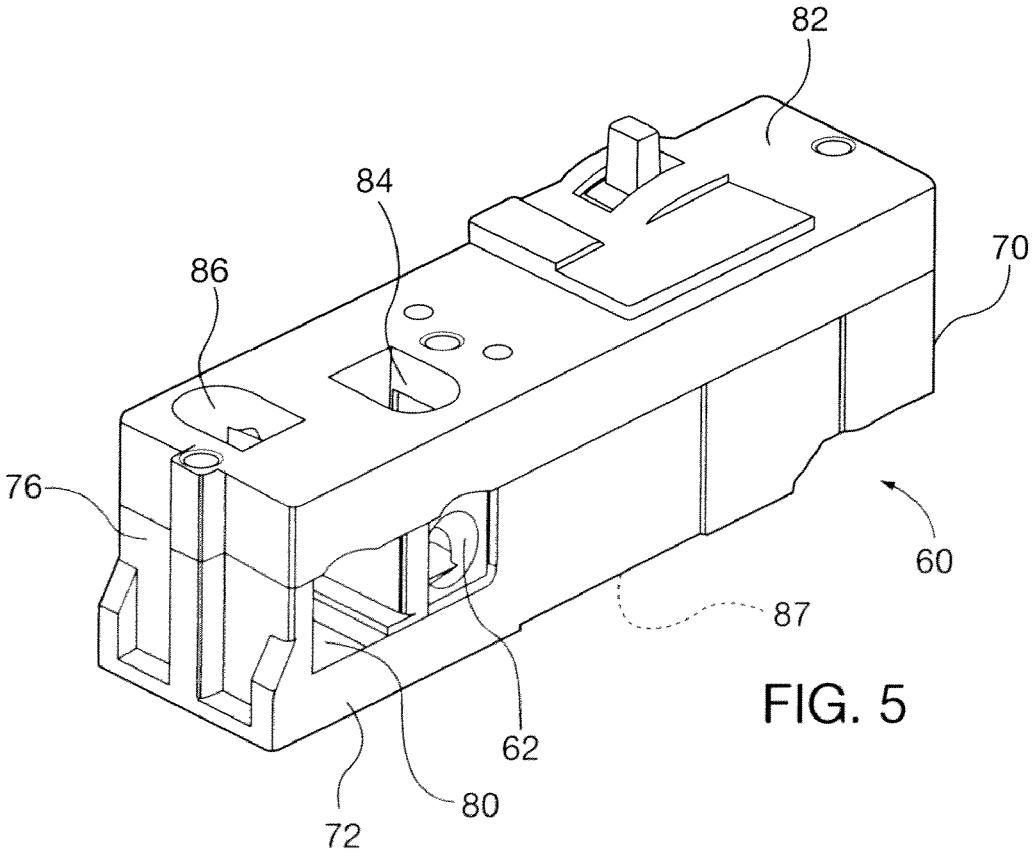
FIG. 5 is a top left side perspective view of the circuit breaker of FIG. 4.
Figure 6:
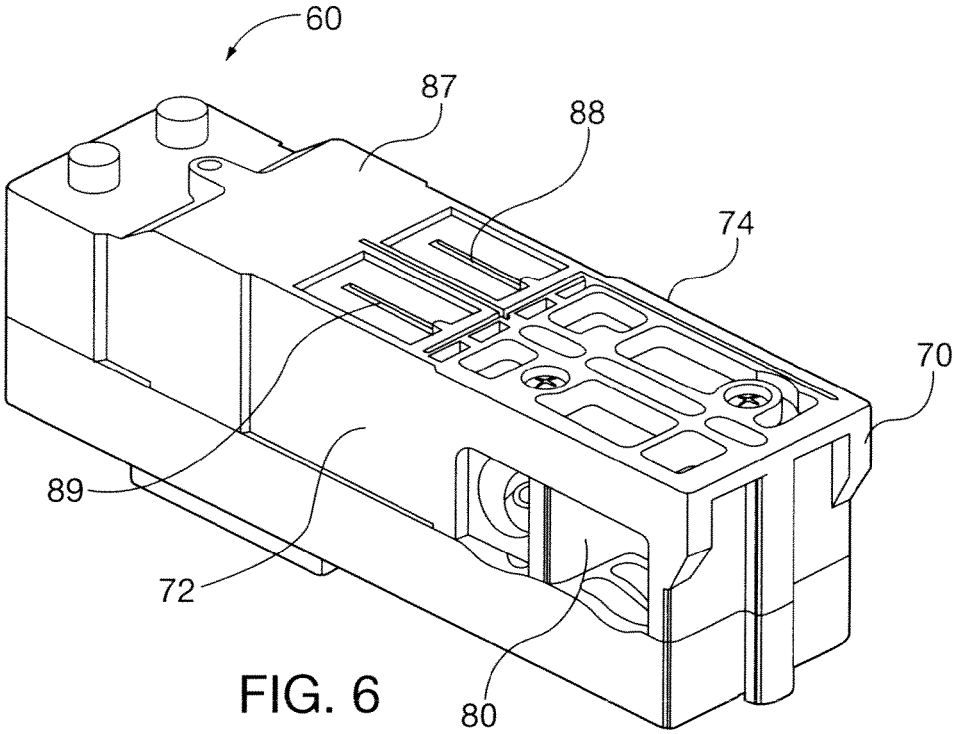
FIG. 6 is a bottom left perspective view of the circuit breaker of FIG. 4.

An embodiment of the circuit breakers of the present invention that enables selective left or right or combination of both side wiring is shown in FIGS. 4-6. Referring generally to those figures, circuit breaker 60 has a wiring connector left lug 62 of conventional design, with an allen screw 64 for selective retention of an electrical conductor, such as a cable or wire 16. Other types of wiring connectors known in the art can be substituted for lug 62. The circuit breaker 60 is a two pole or phase device and therefore has a right lug 66 with allen screw 68 for selective retention of another phase wire 16. The present invention can be utilized in single-pole or multi-pole applications.

The circuit breaker 60 has a non-conductive breaker housing including a base portion 70 that defines a left side wall 72, a right side wall 74 and a top wall 76. The breaker housing 70 defines respective non-conductive left and right lug channel cavities 78, 80 that pass through the right 74 and left 72 side walls. The left lug 62 is captured in the left channel 78 and the right lug 66 is correspondingly captured in the right channel 80. The electrically isolated, non-conductive channel cavities 78, 80 isolate the respective electrical phases from each other and from other components in the vicinity of the breaker lugs 62, 66. An electrical cable or other conductor for each phase may be passed through the respective channel cavity 78, 80 from either the left or right side or a combination of both, for capture by the respective lug 62, 66. Thereupon the conductor is restrained in the lug by tightening of the appropriate lug screw 64, 68 through the housing front cover 82 respective window 84, 86.

Figure 7:
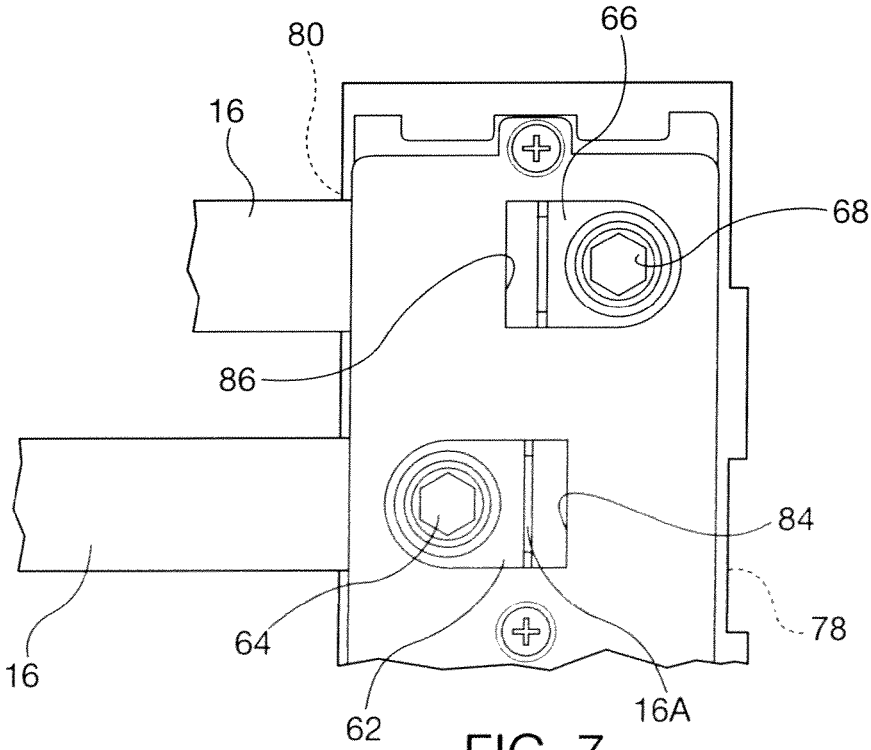
FIG. 7 is a partial front elevational view of the circuit breaker of FIG. 4.
Figure 8A:
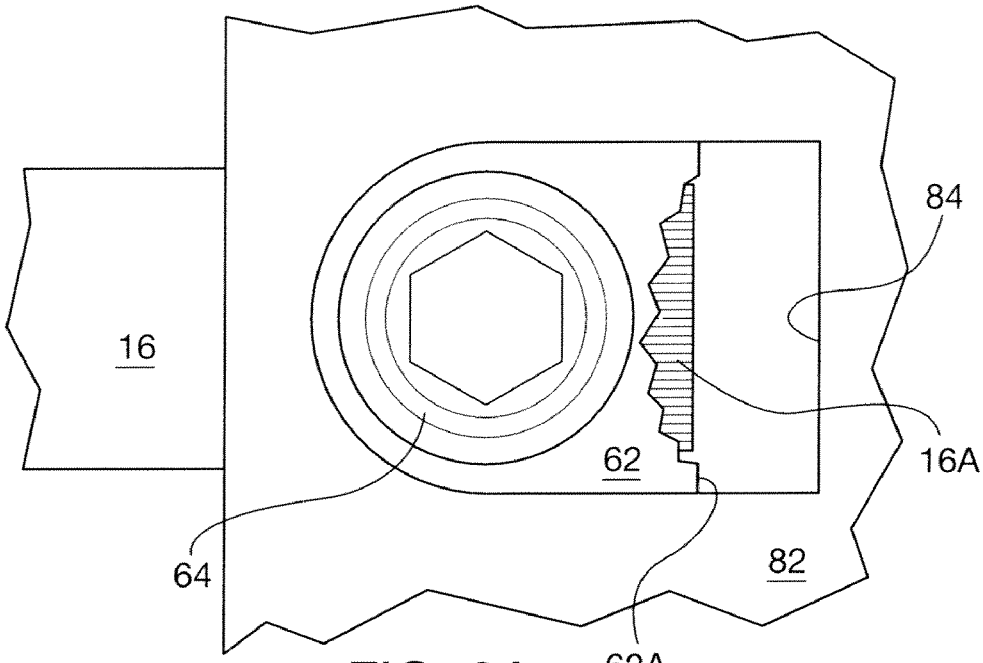
FIGS. 8A and 8B are fragmentary front plan views of a visualization window embodiment of the circuit breaker of the present invention, showing cable retention through a visualization window feature of the present invention.
Figure 8B:
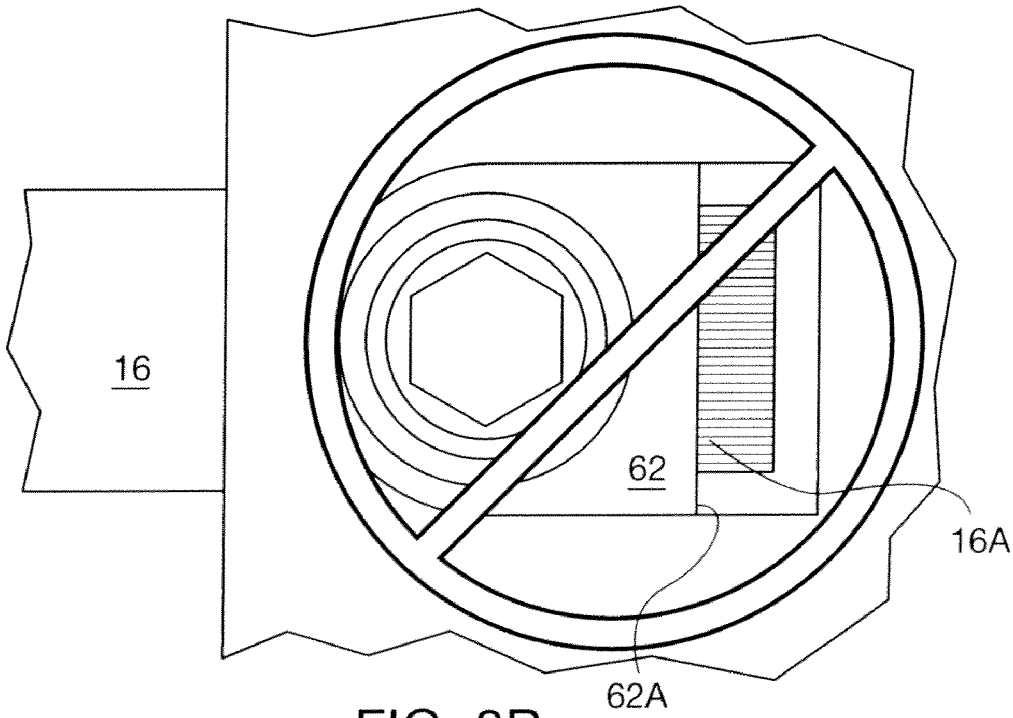

Referring now to FIGS. 7, 8A and 8B, in an embodiment of the present invention the lug windows 84, 86 provide for visual inspection of each lug 62, 66 and their respective lug faces (e.g., 62A in FIGS. 8A and 8B). The windows 84, 86 allow an installer to see wire extension 16A beyond the lug faces 62A as a way to prevent excess extension of wire into the enclosure interior. This feature is helpful to assure compliance with over surface spacing requirements in electrical codes, such as UL 489. Section 6.6.6.

The housing front cover 82 also provides access to the circuit breaker toggle 83 that selectively opens, closes and resets circuit breaker contacts (not shown). The circuit breaker contacts, internal electrical circuit protection and control apparatus (e.g., toggle mechanism and trip unit) and internal bussing are of any known design and not shown for brevity. The term "housing" is used herein to describe the circuit breaker encasement structure that as shown in this embodiment includes a housing base 70 and housing front cover 82. It is possible that the base and cover (or any portions thereof, may be constructed as a unified molding.

Referring to FIG. 6, the breaker housing bottom 87 retains a pair of female biased jaws 88, 89 for connection to bus stabs in the electrical enclosure (not shown) and are of known design. Electrical current flows through the jaws and a respective line bus (not shown) for each phase, through the respective closed circuit breaker contacts and in turn to the respective load busses connected to each of the respective left and right lugs 62, 66.

Figure 9:
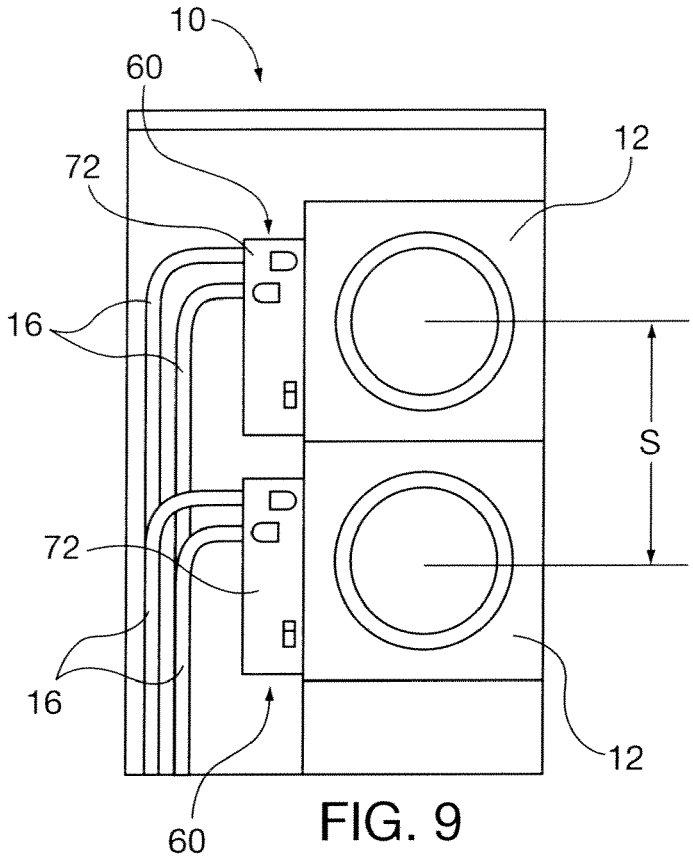
FIG. 9 is a schematic view of an electrical enclosure showing application of an embodiment of a circuit breaker of the present invention configured for left side connection to power cables routed in a left cable gutter.
Figure 10:
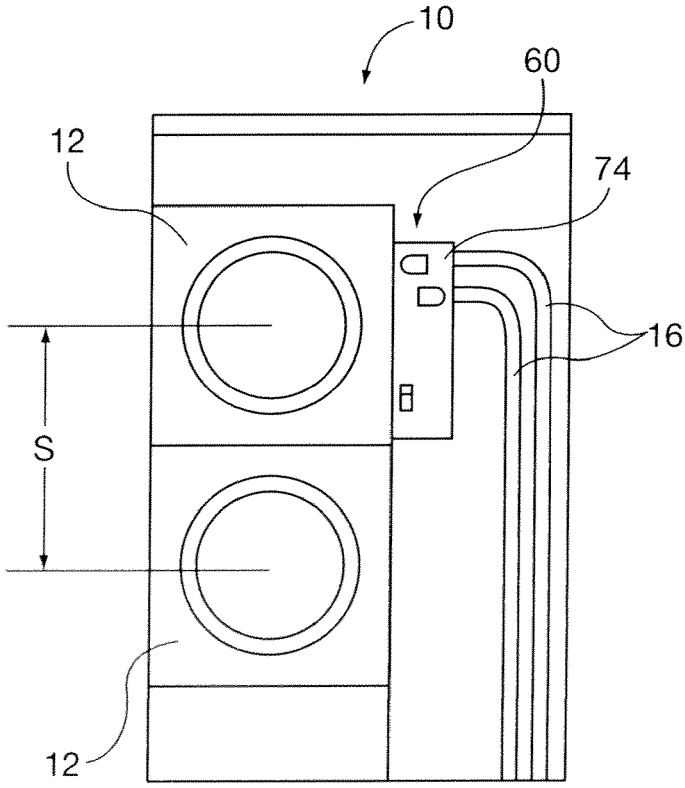
FIG. 10 is a schematic view similar to FIG. 9, showing right side connection to power cables routed in a right cable gutter.

FIGS. 9 and 10 show application of the circuit breaker 60 of the present invention in respective left gutter and right gutter configurations. In FIG. 9 the load cables 16 are inserted in the left side wall 72 of the breaker. Conversely in FIG. 10 the power conductor cables 16 are inserted in the right side wall 72 of the breaker. In both figures, the ability to insert power cables 16 by a simple L-bend rather than a U-bend shown in a FIG. 1 prior art configuration enables reduction of the vertical spacing S between the ganged meters 12.

FIGS. 11-17 show another embodiment of circuit breaker 90 of the present invention in which the left and right load lugs 92, 96 can be oriented in a horizontal position, generally aligned with the longitudinal axis of the breaker or in a vertical position generally normal to the breaker longitudinal axis. The vertical position enables routing of cables above the circuit breaker top cover. While the specific embodiment in FIGS. 11-17 shows a circuit breaker with convertible lug orientation to either horizontal or vertical positions, one skilled in the art can appreciate that a circuit breaker can be constructed with the lugs oriented only in a fixed, vertical position.

Figure 11:
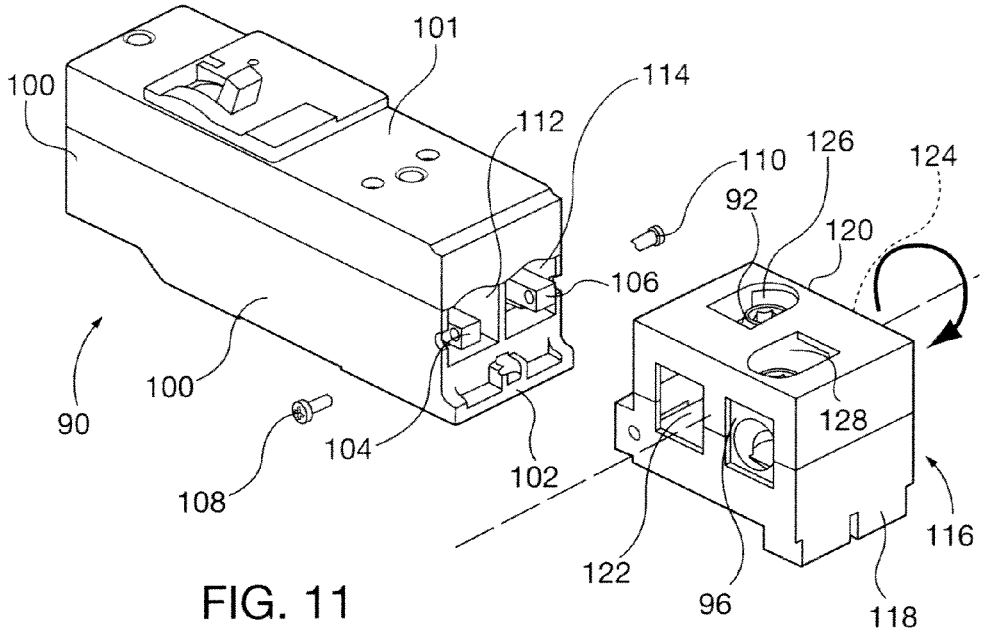
FIG. 11 is a perspective exploded view of an another embodiment of the circuit breaker of the present invention having a detachable lug receptacle oriented parallel to the circuit breaker longitudinal axis in a horizontal position.
Figure 12:
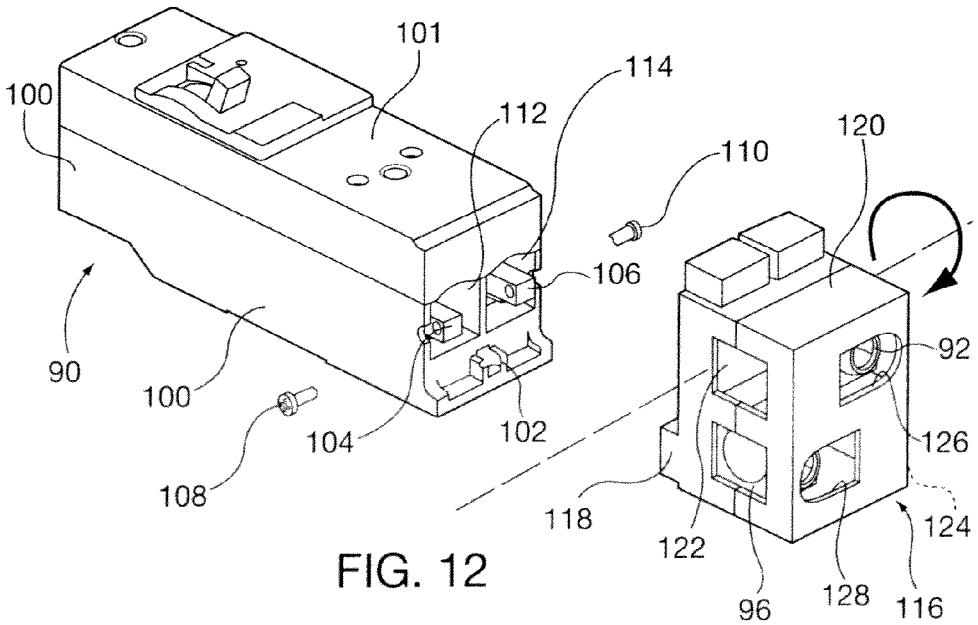
FIG. 12 is a perspective exploded view similar to that of FIG. 11, having a detachable lug receptacle oriented normal to the circuit breaker longitudinal axis in a vertical position.
Figure 14:
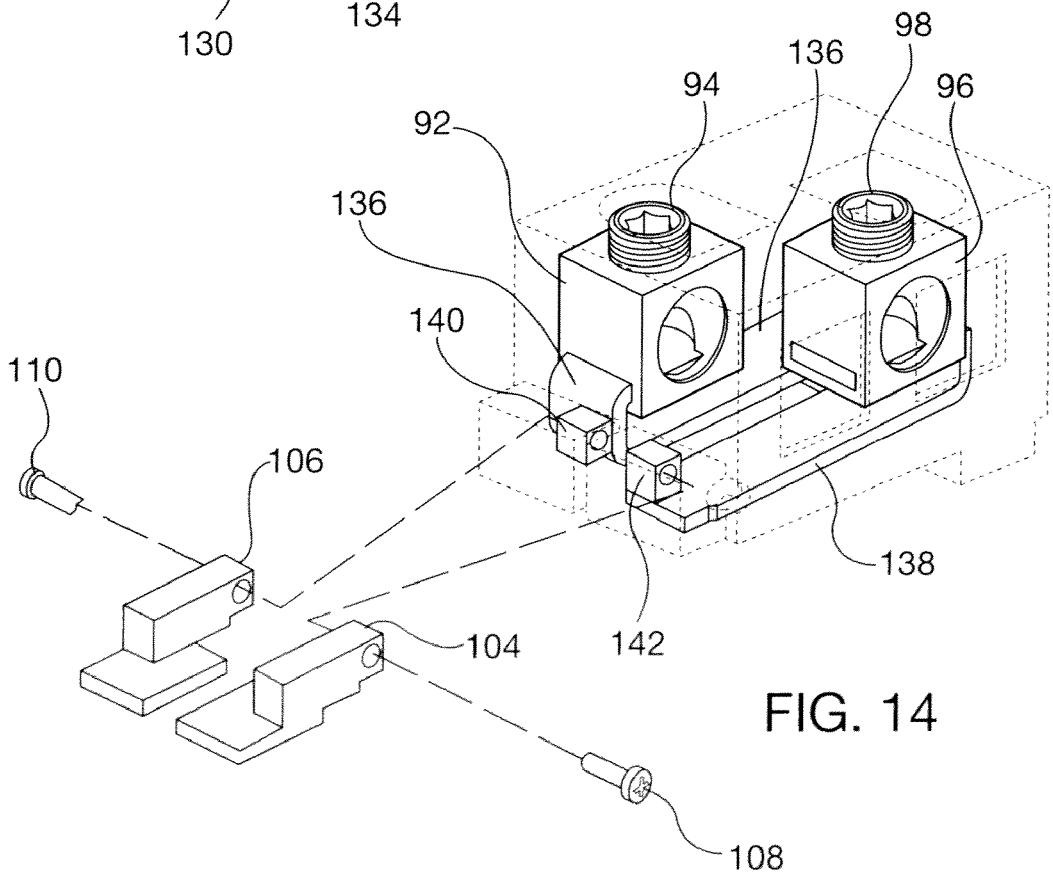
FIG. 14 is a perspective view of the conductor lugs retained in the receptacle housing of FIG. 13 when oriented in a horizontal position.

Referring to FIGS. 11 and 14, the circuit breaker 90 has many features similar to the circuit breaker 60 of FIGS. 4-10, including left lug 92 with allen screw 94, the right lug 96 with allen screw 98, breaker housing base 100 and front cover 101. The housing has a front side 102 that retains a pair of load bus tabs 104, 106 that in this exemplary embodiment have threaded bores for receipt of load bus fasteners 108, 110. The load bus tabs 104, 106 are oriented in load bus housing channels 112, 114.

The circuit breaker 90 has a detachable lug receptacle 116 that is formed with lug receptacle base 118 and lug receptacle cover 120. As with the circuit breaker housing 102, the receptacle base 118 and cover 120 may be constructed as separate components, as shown, or integrated in whole or in part. As one skilled in the art can appreciate, all or portions of the housing 110 and receptacle 116 can be formed in a unitary construction, such as by way of example orienting the lugs permanently in a vertical position during manufacture.

The lug receptacle 116 may be transposed from a horizontal orientation (FIG. 12) or a vertical orientation (FIG. 13) during factory assembly of the breaker 90 or during field installation. In this manner, a single receptacle design may be used in two different applications, thus eliminating the need to manufacture and inventory separate products for each application.

The receptacle 116 forms a left lug channel 122 and a right lug channel 124, as was described with respect to the circuit breaker 60 embodiment, above. Left and right lug windows 126, 128 are shown, having the construction and features of the circuit breaker 60 lug windows 84, 86.

Figure 13:
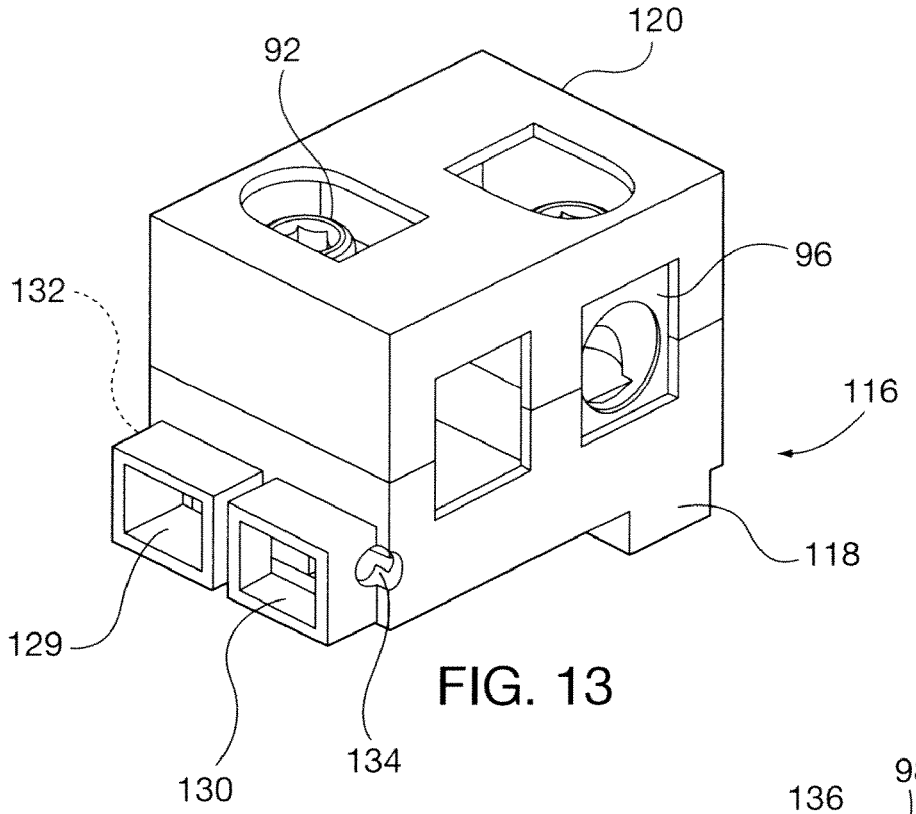
FIG. 13 is a perspective view of the receptacle housing of FIG. 11.

FIGS. 13 and 14 show in further detail the receptacle 116 components as configured for horizontal lug orientation. The receptacle base 118 is constructed with load bus attachment openings 129, 130 for communication with the housing channels 112, 114 and defines holes 132, 134 for passage of the load bus fasteners 108, 110 previously described. Left and right receptacle busses 136, 138 are connected to the respective left 92 and right 96 lugs by a U-shaped tongue in each bus mating with a slot in each lug in a manner known to those skilled in the art. Left and right horizontal threaded blocks 140, 142 are constructed as part of each of the respective receptacle busses 136, 138 for connection to load bus tabs 104, 106 by way of the fasteners 108, 110. Any form of fastener known to those skilled in the art suitable for electrical conductor connectivity in circuit breaker applications may be utilized as a substitute for the threaded fasteners 108, 110.

Figure 15:
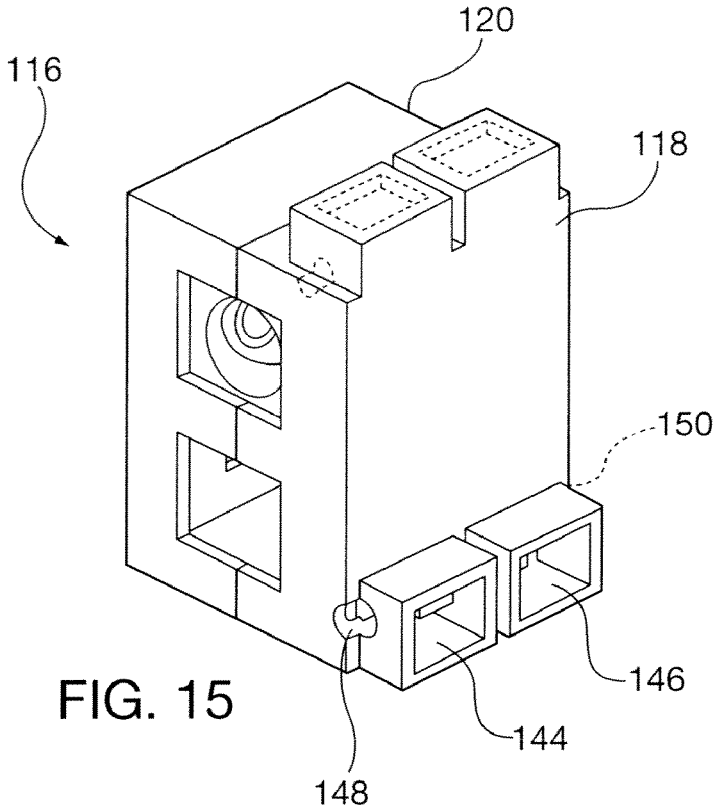
FIG. 15 is a perspective view of the receptacle housing of FIG. 12.
Figure 16:
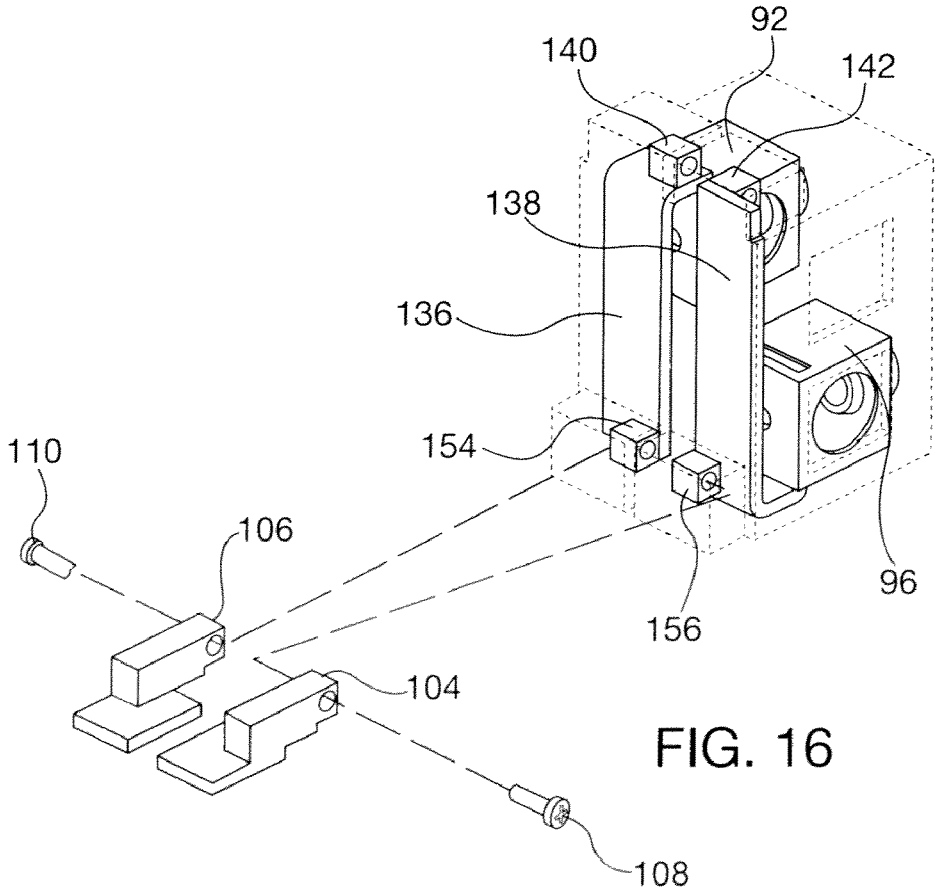
FIG. 16 is a perspective view of the conductor lugs retained in the receptacle housing of FIG. 15 when oriented in a vertical position.

FIGS. 15 and 16 show in further detail the receptacle 116 components as configured for vertical lug orientation. The receptacle base 118 is constructed with load bus attachment openings 144, 146 for communication with the housing channels 112, 114 and defines holes 148, 150 for passage of the load bus fasteners 108, 110 previously described. Left and right receptacle busses 136, 138 are the same as those utilized in the horizontal lug orientation application and are connected to the respective left 92 and right 96 lugs by a U-shaped tongue in each bus mating with a slot in each lug in a manner known to those skilled in the art. Left and right horizontal threaded blocks 154, 156 are disposed on opposite sides of the blocks 140, 142 that were utilized for the horizontal lug orientation configuration. The threaded blocks 154, 156 are constructed as part of each of the respective receptacle busses 136, 138 for connection to load bus tabs 104, 106 by way of the fasteners 108, 110.

Figure 17:
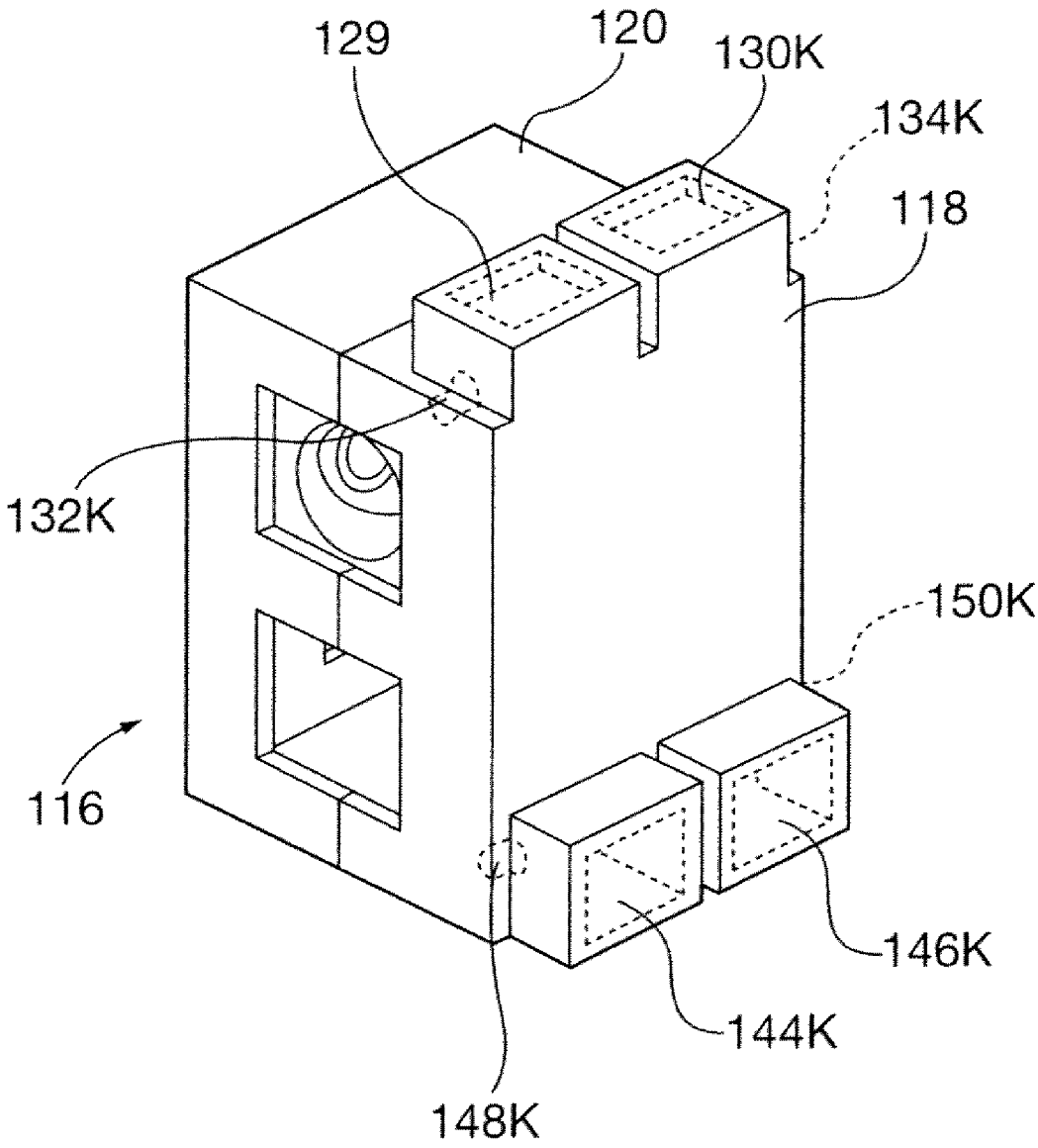
FIG. 17 is a perspective view of the receptacle housing of the present invention corresponding to the embodiment of FIGS. 11 and 12, showing position of knock-outs for selective orientation and connection of the housing to the circuit breaker.

FIG. 17 shows an embodiment of the receptacle base 118 wherein all of the load bus tab 104, 106 attachment openings and holes for corresponding fasteners 108, 110 are formed as knockouts 129K, 130K, 132K, 134K for horizontal lug orientation. Similar knockouts for vertical lug orientation are shown as 144K, 146K, 148K and 150K. In this manner, a field installer can determine whether an application calls for horizontal or vertical lug orientation and thereafter remove the appropriate set of knockouts for the desired application.

As can be appreciated by those skilled in the art, the circuit breaker of the present invention affords a designer and installer a flexible application product that can be adapted to meet varying wire routing design constraints.

Although various exemplary embodiments which incorporate the teachings of the present invention have been shown and described in detail herein, those skilled in the art can readily devise many other varied embodiments that still incorporate these teachings. Accordingly it is intended that the scope of the present be defined by the accompanying claims given their broadest interpretation allowable by law, rather than by the exemplary embodiments described above that are intended to help those skilled in the art understand how to make and use the subject invention.

What is claimed is:

1. A circuit breaker comprising:

a housing defining a longitudinal axis, having left and right surfaces that are generally aligned with the longitudinal axis;

an electrically non-conductive cavity commonly defined by the housing left and right surfaces, that is adapted for selective insertion and receipt of a power circuit conductor within either the left or right housing surface; and a wiring connector retained in a single fixed position within the cavity, adapted for retention of a power circuit conductor inserted therein from either the left or right housing surface.

2. The circuit breaker of claim 1, further comprising an inspection window defined by the housing, oriented for visual inspection of at least a portion of the wiring connector and any power circuit conductor that is retained thereby.

3. The circuit breaker of claim 1, wherein the wiring connector is a lug that defines a face and a bore in the face for receipt of a power circuit conductor, and a terminal screw in communication with the bore.

4. The circuit breaker of claim 3, further comprising an inspection window defined by the housing, oriented for access to the terminal screw and for visual inspection of the lug face and any power circuit conductor that is retained in the bore.

5. The circuit breaker of claim 1, comprising two separate phases each having all of the elements recited therein, wherein the wiring connectors for each phase are staggered relative to the longitudinal axis and the respective cavities are electrically isolated from each other.

6. A circuit breaker comprising:

a housing defining a longitudinal axis, having left and right surfaces that are generally aligned with the longitudinal axis;

an electrically non-conductive cavity commonly defined by the housing left and right surfaces, that is adapted for selective insertion and receipt of a power circuit conductor within either the left or right housing surface;

a wiring connector retained in a single fixed position within the cavity, adapted for retention of a power circuit conductor inserted therein from either the left or right housing surface;

a front cover spanning the entire cavity, incapable of blocking access thereto from the left or right housing surfaces, coupled to the housing; and an inspection window defined by the front cover, oriented for visual inspection of at least a portion of the wiring connector and any power circuit conductor that is retained thereby.

7. The circuit breaker of claim 6, wherein the wiring connector is a lug that defines a face and a bore in the face for receipt of a power circuit conductor, and a terminal screw in communication with the bore.

8. The circuit breaker of claim 6, wherein the inspection window is oriented for access to the terminal screw and for visual inspection of the lug face and any power circuit conductor that is retained in the bore.

9. The circuit breaker of claim 6, comprising two separate phases each having all of the elements recited therein, wherein the wiring connectors for each phase are staggered relative to the longitudinal axis and the respective cavities are electrically isolated from each other.

10. A circuit breaker comprising:

a housing defining a first longitudinal axis and a receptacle portion selectively attachable to the housing, having left and right surfaces that are generally aligned with a second longitudinal axis, wherein the respective longitudinal axes are aligned generally normal to each other;

an electrically non-conductive cavity commonly defined by the receptacle left and right surfaces, that is adapted for selective insertion and receipt of a power circuit conductor within either the left or right surface; and a wiring connector retained in a single fixed position within the cavity, adapted for retention of a power circuit conductor inserted therein from either the left or right housing surface.

11. The circuit breaker of claim 10, further comprising an inspection window defined by the housing, oriented for visual inspection of at least a portion of the wiring connector and any power circuit conductor that is retained thereby.

12. The circuit breaker of claim 10, wherein the wiring connector is a lug that defines a face and a bore in the face for receipt of a power circuit conductor, and a terminal screw in communication with the bore.

13. The circuit breaker of claim 12, further comprising an inspection window defined by the housing that is oriented for access to the terminal screw and for visual inspection of the lug face and any power circuit conductor that is retained in the bore.

14. The circuit breaker of claim 13, comprising two separate phases each having all of the elements recited therein, wherein:

the lugs for each phase are staggered relative to the longitudinal axis and the respective cavities are electrically isolated from each other; and the receptacle is selectively attachable to the housing in a first orientation with the respective longitudinal axes aligned generally in parallel and in a second orientation with the respective longitudinal axes aligned generally normal to each other.

15. The circuit breaker of claim 10, comprising two separate phases each having all of the elements recited therein, wherein the wiring connectors for each phase are staggered relative to the longitudinal axis and the respective cavities are electrically isolated from each other.

16. A circuit breaker comprising:

a housing defining a first longitudinal axis;

a load bus tab oriented in a fixed position within the housing;

a receptacle having left and right surfaces that are generally aligned with a second longitudinal axis, the receptacle selectively attachable to the housing in a first orientation with the respective longitudinal axes aligned generally in parallel and in a second orientation with the respective longitudinal axes aligned generally normal to each other;

an electrically non-conductive cavity commonly defined by the receptacle left and right surfaces, that is adapted for selective insertion and receipt of a power circuit conductor within either the left or right surface;

a receptacle bus oriented in a fixed position within the receptacle, having separate first and second blocks on opposite ends thereof for respective direct coupling to the load bus tab when the receptacle is in the respective first and second orientations; and a wiring connector retained within the cavity and coupled to the receptacle bus, adapted for retention of a power circuit conductor a wiring connector retained within the cavity, adapted for retention of a power circuit conductor.

17. The circuit breaker of claim 16, further comprising an inspection window defined by the receptacle, oriented for visual inspection of at least a portion of the wiring connector and any power circuit conductor that is retained thereby.

18. The circuit breaker of claim 16, further comprising:

threaded bores defined by each of the load bus tab and first and second blocks;

holes respectively defined by the receptacle for communication with the respective first and second block threaded bores;

a load bus tab threaded bore; and a threaded fastener coupling the bus tab threaded bore and one of the respective first and second block thread bores when the receptacle and housing are aligned in the respective first and second orientations, the fastener being inserted through one of the respective receptacle holes.

19. The circuit breaker of claim 17, comprising two separate phases each having all of the elements recited therein, wherein the wiring connectors for each phase are staggered relative to the second longitudinal axis and the respective cavities are electrically isolated from each other.

20. The circuit breaker of claim 16 further comprising:

an inspection window defined by the receptacle, oriented for visual inspection of at least a portion of the wiring connector and any power circuit conductor that is retained thereby; and wherein the wiring connector is retained in a single fixed position within the cavity, adapted for retention of the power circuit conductor inserted therein from either the left or right housing surface.

* * * * *